United States Patent [19]

Baird

[11] 4,387,637

[45] Jun. 14, 1983

[54] CONTAINER CRUSHING DEVICE

[76] Inventor: Leonard B. Baird, 505 Highland Ave. N., Jasper, Ala. 35501

[21] Appl. No.: 292,955

[22] Filed: Aug. 14, 1981

[51] Int. Cl.[3] ..... B30B 9/32

[52] U.S. Cl. ..... 100/264; 100/288; 100/295; 100/902

[58] Field of Search ..... 100/902, 288, 264, 244, 100/295; 99/581, 582, 583

[56] References Cited

U.S. PATENT DOCUMENTS

| | | | |
|---|---|---|---|
| 2,466,907 | 4/1949 | Nadolny et al. | 100/902 X |
| 2,614,604 | 10/1952 | Coffey | 100/902 X |
| 3,766,849 | 10/1973 | Maron | 100/902 X |
| 3,776,129 | 12/1973 | Carlson | 100/902 X |
| 3,948,164 | 4/1976 | Poduda et al. | 100/902 X |
| 3,980,015 | 9/1976 | Woodard | 100/902 X |
| 4,176,597 | 12/1979 | Stevenson | 100/244 |
| 4,235,164 | 11/1980 | Allen et al. | 100/902 X |

*Primary Examiner*—Billy J. Wilhite

*Attorney, Agent, or Firm*—Woodford R. Thompson, Jr.

[57] ABSTRACT

A device for crushing containers embodies a base having a supporting surface for receiving the container to be crushed. Upstanding crushing members are mounted for rectilinear movement along the supporting surface selectively to a first position in spaced relation to each other for receiving the container to be crushed and to a second position with the crushing members being juxtaposed relative to each other to crush the container. Elongated power transmitting members are connected to the crushing members and are mounted for sliding movement along the supporting surface. A power transmitting element is mounted for rotation above each power transmitting member and imparts rectilinear movement thereto and to the crushing members carried thereby selectively to their first and second positions.

8 Claims, 5 Drawing Figures

CONTAINER CRUSHING DEVICE

BACKGROUND OF THE INVENTION

This invention relates to a device for crushing containers and more particularly to such a device which is adapted to crush metal beverage cans and the like to a compacted size for convenient storage and transportation to a recycling operation or disposal site.

Heretofore in the art to which my invention relates, various devices have been devised for crushing recycleable metal cans. Conventional can crushing devices with which I am familiar are disclosed in the following U. S. Pat. Nos. 3,980,015; 3,948,164; 3,776,129; 3,766,849, 2,614,604; and 2,466,907. Such devices have pivotally mounted crushing members which require a considerable amount of effort to be exerted by the user to flatten and crush the can to the desired shape. Also, difficulties have been encountered in retaining the can in place properly as it is being crushed.

SUMMARY OF THE INVENTION

In accordance with my invention, I overcome the above and other difficulties by providing an improved device for crushing containers, such as metal beverage cans and the like, which is simple of construction and economical of manufacture. My improved device requires a minimum of time and effort to crush such containers to a compacted size for convenient transportation and storage. Also, my improved device provides means for positively retaining the container in place as the crushing members engage and crush the ends of the container.

My improved device for crushing containers includes a base which has a supporting surface for receiving the container to be crushed. Upstanding oppositely disposed crushing members are mounted for rectilinear movement along the supporting surface selectively to a container receiving position in spaced relation to each other and to a container crushing position in juxtaposed relation to each other. Oppositely disposed elongated power transmitting members are connected to the crushing members and are aligned with each other for sliding movement relative to each other and the supporting surface. A power transmitting element is mounted for rotation above and operatively connected to each power transmitting member for imparting rectilinear movement thereto and the crushing members carried thereby. Upon final movement of the power transmitting elements toward the crushing position, the crushing members are moved upward to a position in parallel relation to each other.

DESCRIPTION OF THE DRAWING

Apparatus embodying features of my invention is illustrated in the accompanying drawing, forming a part of this application, in which.

DETAILED DESCRIPTION

Figure 1:
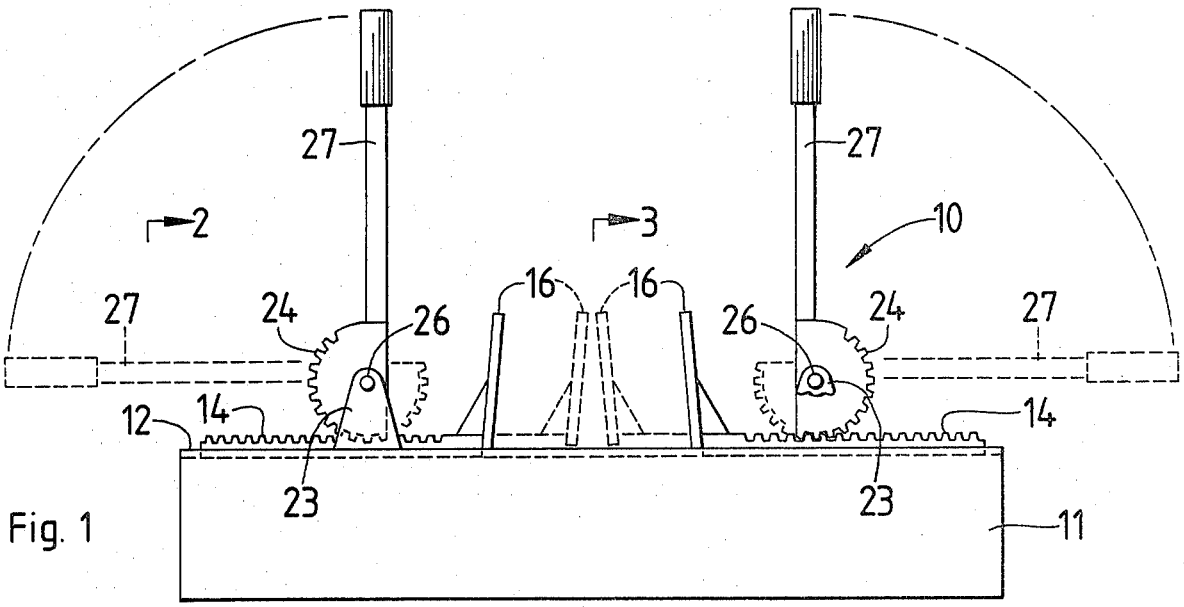
FIG. 1 is a side elevational view showing the upstanding crushing members in the container receiving position in spaced relation to each other in solid lines and in the container crushing position adjacent each other in dotted lines.
Figure 2:
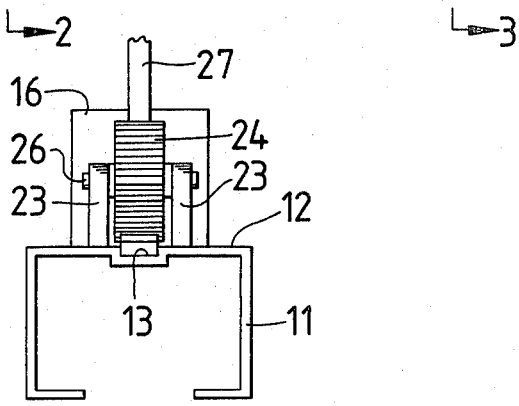
FIG. 2 is an end elevational view taken generally along the line 2—2 of FIG. 1.
Figure 3:
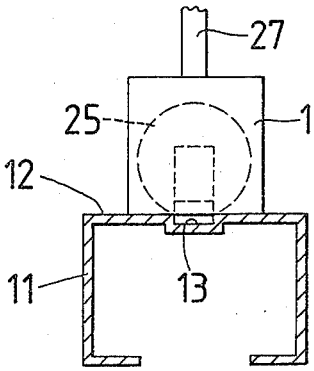
FIG. 3 is a sectional view taken generally along the line 3—3 of FIG. 1.

Referring now to the drawing for a better understanding of my invention, I show in FIG. 1 my improved device 10 for crushing containers, such as recycleable aluminum and steel beverage cans. The device is shown as including a base 11 which has a horizontally extending surface 12 for supporting the container to be crushed. An upwardly opening, longitudinally extending recess 13 is provided in the supporting surface 12 for receiving a pair of elongated oppositely disposed power transmitting members 14. The members 14 are shown as being in the form of racks which are in alignment with each other and adapted to slide freely and rectilinearly within the recess 13, as shown.

Figure 4:
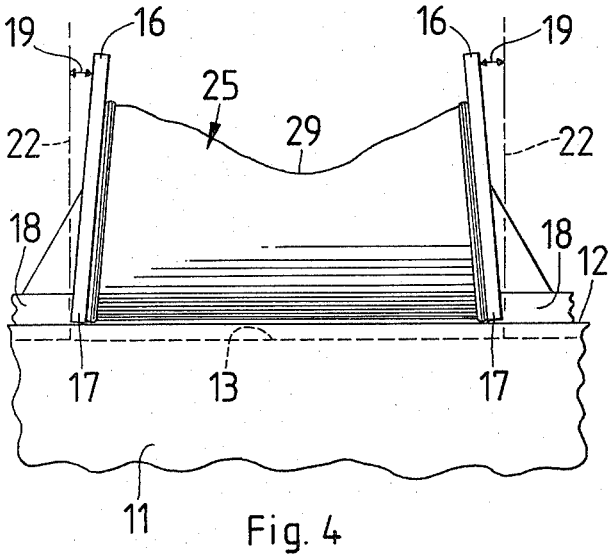
FIG. 4 is an enlarged fragmental side elevational view corresponding to FIG. 1 showing a container positioned between the upstanding crushing members; and, FIG. 5 is a fragmental side elevational view corresponding to FIG. 4 showing the crushing members in the container crushing position in juxtaposed relation to each other for crushing the container uniformly across its width.
Figure 5:
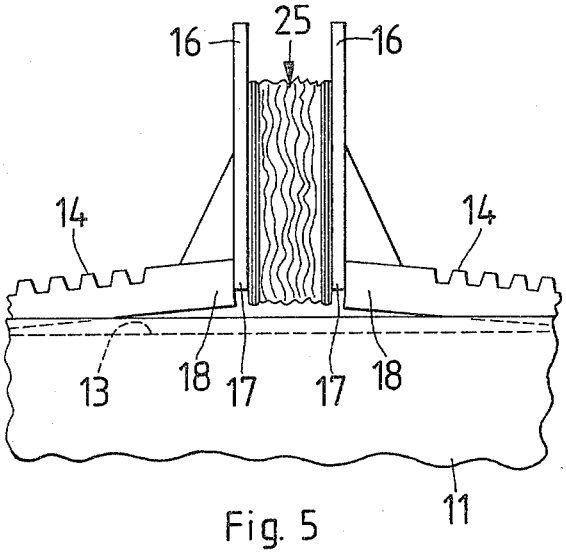

An upstanding plate-like crushing member 16 is carried by the inner end of each member 14 and is also adapted for rectilinear movement therewith along the supporting surface 12 of the base 11. That is, the lower end portion 17 of each plate-like member 16 is connected to the innermost end 18 of the power transmitting member 14 adjacent thereto. The plate-like members 16 are thus disposed for rectilinear movement relative to the supporting surface 12 selectively to a first position with the members 16 being spaced from each other to receive a container to be crushed. In FIG. 5, I show the members 16 in a second position juxtaposed relative to each other and crushing the container uniformly across its width. The plate-like members 16 are inclined upwardly and inwardly toward each other at acute angles 19 relative to a vertical plane 22 passing through each plate-like member 16, as shown in FIG. 4. In actual practice, I have found that an acute angle 19 ranging from approximately 3° to 7° will crush most metal beverage cans satisfactorily in every respect. However, an acute angle 19 of approximately 5° is preferred.

As shown in FIG. 1, a pair of laterally spaced upstanding mounting brackets 23 are secured to the supporting surface 12 of the base 11 inwardly of each end thereof. A power transmitting element 24, which may be in the form of a pinion, is mounted for rotation on a pin 26 extending between each pair of laterally spaced brackets 23. Accordingly, each pinion is mounted above its power transmitting rack and is adapted to impart rectilinear movement thereto. The plate-like members 16 carried by the member 14 are thus adapted to be moved selectively to the first position with the upstanding plate-like members 16 being spaced from each other for receiving the container being crushed, indicated at 25, and to the second position with the plate-like members 16 being juxtaposed relative to each other to crush the container. While I have shown the power transmitting members 14 and power transmitting elements 24 as being racks and pinions respectively, it will be apparent that other conventional forms of power transmitting members may be employed.

An elongated lever arm 27 is connected at one end to each of the power transmitting elements 24 and is adapted to move selectively to an upper inoperative position as shown in solid lines in FIG. 1 and to an operating position with the lever arms extending in generally horizontal directions away from each other, as shown in dotted lines in FIG. 1.

It will thus be seen that when the lever arms 27 are in the inoperative position, the plate-like members 16 are spaced from each other to receive the container 25 to be crushed. Upon downward pivotal movement of the lever arms 27 toward the operative position, the upwardly and inwardly extending plate-like members 16 first engage the upper portion of each end of the container 25 and retain it in place during the crushing stroke. As the upper end portions of the container 25 are bent inwardly, a depression 29 is formed in the upper side wall of the container, as shown in FIG. 4. The depression 29 and the inwardly bent ends reduce the container's resistance to the longitudinally applied crushing forces exerted by the plate-like members 16. That is, the depression 29 reduces the resistance of the container's longitudinal walls to the compressive forces applied while the inwardly bent ends reduce the bracing effect that the ends of the container exert relative to the longitudinal walls of the container.

As the lever arms 27 are moved toward their operative positions, the plate-like members 16 first crush the container to a generally trapezoidal shape. That is, as viewed from the side, the lower portions of the container 25 are spaced from each other a greater distance than the upper end portions thereof. Final movement of the lever arms 27 toward the lower operative position pivots the innermost ends 18 of the power transmitting members 14 upwardly so that the plate-like members 16 extend generally parallel to each other and thus crush the lower end portions of the container to substantially the same thickness as the upper end portions thereof, as shown in FIG. 5.

From the foregoing description, the operation of my improved device for crushing containers, such as metal beverage cans, will be readily understood. With the lever arms 27 in the upper inoperative position and the plate-like members 16 in spaced relation to each other, a container 25 to be crushed is placed on the supporting surface 12. The lever arms 27 are then pivoted downwardly toward their operative positions while concomitantly urging the plate-like members 16 into engagement with the ends of the container 25 to be crushed. The depression 29 is formed as the ends of the container 25 are moved toward each other to form the generally trapezoidal crushed shape. Final downward movement of the lever arms 27 pivots the innermost ends 18 of the power transmitting members 14 upwardly so that the lower portions of the plate-like members 16 move toward each other and crush the article to a substantially uniform thickness, as shown in FIG. 5. The lever arms 27 are then pivoted to the upper inoperative position and the crushed container is removed.

From the foregoing, it will be seen that I have devised an improved device for crushing containers which requires a minimum of time and effort to crush containers, such as metal beverage cans, to compact and convenient size for storage and transportation. Also, by providing upwardly and inwardly extending crushing members my improved device positively retains the container in place during the crushing stroke and assures that the article is crushed uniformly. Furthermore, my improved device for crushing containers is simple of construction and economical of manufacture.

While I have shown my invention in but one form, it will be obvious to those skilled in the art that it is not so limited, but is susceptible of various changes and modifications without departing from the spirit thereof.

What I claim is:

1. A device for crushing containers comprising:

(a) a base having a supporting surface adapted to receive a container to be crushed, (b) a pair of upstanding oppositely disposed crushing members mounted for rectilinear movement along said supporting surface selectively to a first position with said upstanding members being spaced from each other for receiving the container to be crushed and to a second position with said upstanding members being juxtaposed relative to each other to crush said container, (c) an upwardly opening longitudinally extending recess in said supporting surface, (d) a pair of elongated power transmitting members mounted for sliding movement within said recess with the innermost end of each said power transmitting member secured to the upstanding crushing member adjacent thereto, and (e) a power transmitting element mounted for rotation above and operatively connected to each said elongated power transmitting member and adapted to impart rectilinear movement thereto to move its upstanding crushing member selectively to said first position and to said second position.

2. A device for crushing containers as defined in claim 1 in which each said power transmitting member is a rack and each said power transmitting element is a pinion.

3. A device for crushing containers as defined in claim 1 in which an elongated lever arm is connected at one end to each said power transmitting element and is disposed for pivotal movement selectively to an inoperative position with said lever arm extending upwardly and positioning its upstanding crushing members in said first position and to an operative position with said lever arms extending in generally horizontal directions away from each other and urging said crushing members toward said second position.

4. A device for crushing containers as defined in claim 3 in which each said upstanding crushing member is inclined upwardly and inwardly at an acute angle relative to a vertical plane passing therethrough.

5. A device as defined in claim 4 in which said acute angle ranges from approximately 3° to 7°.

6. A device as defined in claim 5 in which said acute angle is approximately 5°.

7. A device as defined in claim 4 in which said upstanding crushing members are plate-like members.

8. A device as defined in claim 4 in which the axis of rotation of each said power transmitting element is spaced from its crushing member while in said second position so that final movement of the lever arms away from each other imparts upward movement to said crushing members to position said crushing members generally parallel to each other.

* * * * *